US012702221B2

(12) United States Patent
Sweet et al.

(10) Patent No.: US 12,702,221 B2
(45) Date of Patent: Aug. 11, 2026

(54) ROTATING ELECTRIC BRUSH DEVICE

(71) Applicants: Jeff Sweet, Clackamas, OR (US); Ken Genova, Newberg, OR (US)

(72) Inventors: Jeff Sweet, Clackamas, OR (US); Ken Genova, Newberg, OR (US)

( * ) Notice: Subject to any disclaimer, the term of this patent is extended or adjusted under 35 U.S.C. 154(b) by 476 days.

(21) Appl. No.: 18/211,225

(22) Filed: Jun. 16, 2023

(65) Prior Publication Data

US 2023/0404251 A1 Dec. 21, 2023

Related U.S. Application Data

(60) Provisional application No. 63/352,953, filed on Jun. 16, 2022.

(51) Int. Cl.
*A46B 13/02* (2006.01)

(52) U.S. Cl.
CPC ..... *A46B 13/02* (2013.01)

(58) Field of Classification Search
CPC ..... A46B 13/00; A46B 13/02; A46B 13/008; A46B 17/06; A46B 5/00; A46B 5/02; A46B 5/026; A46B 7/00; A46B 7/04; A46B 7/042; A46B 7/044; A46B 7/046; A16B 13/00; A16B 13/02; A16B 13/008; A16B 17/06; A16B 5/00; A16B 5/02; A16B 5/026; A16B 7/00; A16B 7/04; A16B 7/042; A16B 7/044; A16B 7/046
See application file for complete search history.

(56) References Cited

U.S. PATENT DOCUMENTS 2,113,206 A * 4/1938 Yakimchick ..... A46B 17/02 15/144.1
6,158,073 A * 12/2000 Jiovanni ..... A46B 13/001 15/23
8,132,541 B1 * 3/2012 Baer, Jr. ..... A46B 9/023 119/664
9,844,207 B1 * 12/2017 Wright ..... A46B 3/00
2009/0229624 A1 * 9/2009 Purvis ..... A45D 20/525 186/59
2022/0287448 A1 * 9/2022 Durham ..... A46B 15/0051

* cited by examiner

*Primary Examiner* — C. A. Rivera

(57) ABSTRACT

A rotatable electric brush device is provided which may utilize a handle portion disposed at a proximal end thereof. The handle portion may have a hollow handle body having a handle exterior surface defining a handle cavity within the handle body. The handle cavity may have a portion of a driveshaft disposed therein. The rotatable electric brush device may also utilize a brush portion disposed at a distal end of the rotatable electric brush device such that the brush portion may have a hollow brush body having a brush exterior surface defining a brush cavity within the brush body. The brush cavity may utilize a shaft body and a portion of a secondary handle disposed therein and the brush exterior surface may have a plurality of bristles extending outward therefrom.

17 Claims, 10 Drawing Sheets

ROTATING ELECTRIC BRUSH DEVICE

CROSS-REFERENCE TO RELATED APPLICATIONS

This application claims priority to U.S. Provisional Patent Application Ser. No. 63/352,953, entitled "Rotating Electric Brush Device," filed Jun. 16, 2022. The contents of this application are hereby incorporated by reference in their entirety.

BACKGROUND OF THE INVENTION

Animal care and maintenance is a broad industry with wide ranging applications including commercial and residential uses. For instance, the commercial activity of animal production involves caring for and maintaining the health of various domesticated livestock animals in the agricultural setting. Given the financial interest in seeing the livestock to market, it is imperative that these animals remain healthy during their production. One aspect of caring for and maintaining mammalian livestock is the upkeep of their fur, hair, coat, hide, skin and the like.

Similarly, it is very common for residential households to possess a pet such as a dog, cat, rabbit and the like. While there typically is no financial incentive to care for these domestic pet animals, there is a strong familial and emotional incentive to do so. While the standard care for such pets includes regular maintenance of food, water, litter boxes, sleeping arrangements and the like, irregular secondary care for such animals can include maintenance related to the animal's fur, skin, teeth and the like.

Common medical ailments related to, or caused in part by, an animal's fur and skin can include atopic dermatitis, autoimmune skin diseases, ringworm, demodicosis, stomatitis, endocrine disorders, pyoderma, excess shedding, parasites, dandruff, matted fur and the like. Many of these ailments can be treated, at least in part, by therapeutic physical stimulation of the fur, hair and/or skin.

Specifically, brushing of the animal's fur using brushstrokes in therapeutic patterns can stimulate blood circulation in the animal's skin and nearby surface level tissue which naturally provides disease-fighting health benefits in those areas. Further, the physical stimulation of therapeutic brushstrokes can trigger the body's natural oil glands to produce necessary oils and thereafter distribute them across the surface area being brushed with each brushstroke. Additionally, the physical action of each brushstroke removes dirt, grease, dead hair and dead skin from the animal through this process.

Promoting a healthy coat of fur or hair on an animal is, however, not without its challenges. Many factors can limit an animal owner's ability to care for and maintain the fur or hair of the animal. For instance, the physical human action of executing a repetitive pattern of brushstrokes can lead to long-term functional degradation in the body parts used in the process. Further, a pet owner having any type of physical mobility issues with their upper body may find it difficult or impossible to execute repetitive brushstroke patterns.

Even if a pet owner is fully healthy, the process of brushing an animal can be exhausting as the surface area to be brushed increases. Another issue facing pet owners is the ability to control the pattern of therapeutic brushstrokes for precision in path and pressure as the number of brushstroke repetitions increases. These human physical errors can lead to the discomfort of, or even injury to, the animal. Given the amount of time required to manually brush an animal and the regularity of brushing recommended to achieve positive health outcomes, a more efficient and effective process is required to meet this need.

Therefore, it would be advantageous to provide a rotating electric brush device that solves these problems. The iterative rotational movement of the brush device solves the aforementioned issues inherent in repetitive manual brushing as does the automated functioning of it. Much in the same way that the automatic toothbrush has been found to be a more efficient and effective cleaning implement of teeth than traditional toothbrushes, so too can an automatic brush be found to provide better health outcomes for an animal over manual brushing.

Even automated brushes, however, do not fully solve the problems presented. For instance, brushing an animal, particularly in or around delicate areas, can be a difficult process to execute without causing animal discomfort. Therefore, it would be advantageous to provide a rotating electric brush device that allows nuance in application of pressure across the face of the brush. Flat brush heads do not allow such nuance to be achieved. By providing a cylindrical shaped brush that rotates about an axis, a spectrum of applied pressure can be achieved across the outer surface of the brush as it is applied across a given surface of the animal. Specifically, the portion of the cylindrical brush head centered upon the animal surface will apply the greatest pressure while the peripheral portions of the brush head upon the animal surface will only graze the surface and so will generate less pressure the further out into the periphery the portion of the brush is. Further, the periphery of the brush may be utilized for edge brushing of the animal surface at the joints, neck and other bodily crevices of the animal without incurring harm or discomfort to the animal.

Another issue with automated brushes is the danger of human error in applying the brush head to the animal surface. For instance, if the animal owner's hand slips while applying the brush device to the animal, then severe injury can be caused to the animal's hair and/or skin. Further, the automated action of a reciprocating brush may further cause instability in the animal owner's grip on the device itself which similarly can lead to animal injury. Therefore, it would be advantageous to provide a rotating brush head in order to reduce potential user grip instability.

Further, it would be advantageous to provide a secondary grip for the animal owner to grip with their second hand on the other side of the brush head. This would provide the user the ability to apply the brush head to the animal surface with greater precision and control while reducing the risk that the user's hand slips from its grip. Additionally, a secondary grip on the opposite side of the brush head would make it physically less demanding to utilize the brush device by allowing the user to hold it with two hands instead of one.

DETAILED DESCRIPTION OF THE INVENTION

Figure 1:
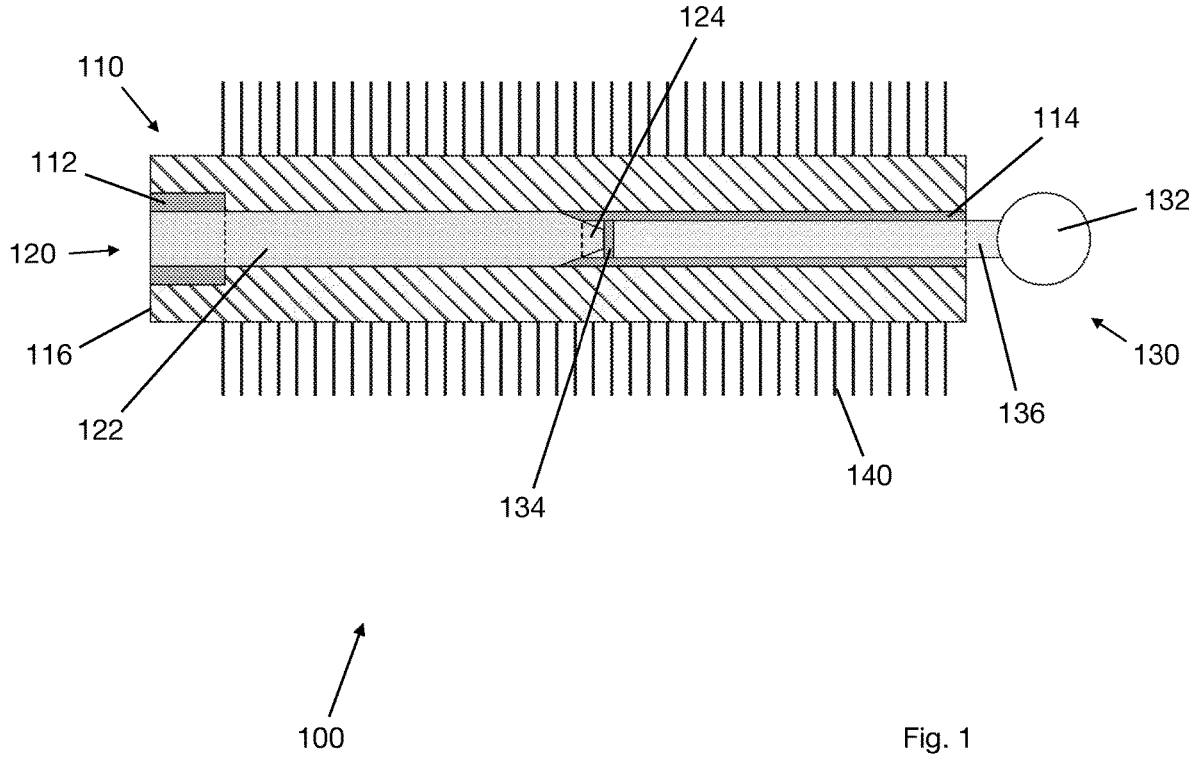
FIG. 1 illustrates a cross-sectional view of a brush portion of a rotating electric brush device in accordance with some embodiments of the present invention.

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a rotating electric brush device" also includes a plurality of rotating electric brush devices and the like. Additionally, use of the terms "fur" and "hair" are interchangeable within this application and imply synonymity with any keratin-based structures. Similarly, the terms "animal owner" and "user" are interchangeable within this application and imply synonymity with any human actor using the brush device. Also, the terms "animal surface", "skin" and "surface level tissue" are interchangeable within this application and imply synonymity with any mammalian outer dermal tissue that can be directly exposed to environmental air such as, but not limited to, skin, gum, eye, ear and nose tissues and other related tissue materials. Further, the terms "brush" and "comb" are interchangeable within this application and imply synonymity with any structural implements used for untangling or arranging any type of hair. Additionally, the terms "elongate bristle member", "bristle" and "tine" are interchangeable within this application and imply synonymity with any stiff, semi-stiff or flexible member having a straight elongate shape with one or more degrees of freedom of flexure.

In some embodiments of the present invention, a rotatable electric brush device is provided comprising a handle portion disposed at a proximal end of the rotatable electric brush device, wherein: the handle portion comprises a hollow handle body having a handle exterior surface defining a handle cavity within the handle body, the handle cavity comprises a portion of a driveshaft disposed therein, wherein the driveshaft is coupled to an electronic drive unit at a proximal end of the driveshaft, the electronic drive unit is electronically coupled to a drive actuator that is not covered by the handle exterior surface, a distal end of the driveshaft is not contained within the handle cavity and is not covered by the handle exterior surface, and the distal end of the driveshaft comprises an inner sheath partially defining an engagement cavity; and a brush portion disposed at a distal end of the rotatable electric brush device, wherein: the brush portion comprises a hollow brush body having a brush exterior surface defining a brush cavity within the brush body, the brush cavity comprises a shaft body and a portion of a secondary handle disposed therein, and the brush exterior surface comprises a plurality of bristles extending outward therefrom.

In some embodiments of the present invention, the secondary handle comprises a hollow elongate coupling rod at a proximal end of the secondary handle and a gripping structure at a distal end of the secondary handle.

In some embodiments of the present invention, a distal end of the hollow elongate coupling rod and the gripping structure are not contained within the brush cavity and are not covered by the brush exterior surface.

In some embodiments of the present invention, the hollow elongate coupling rod comprises a magnetic disc disposed therein.

In some embodiments of the present invention, the shaft body couples to the hollow elongate coupling rod via the magnetic disc at a proximal end of the secondary handle.

In some embodiments of the present invention, the magnetic disc comprises a first degree of freedom of movement axially along the length of the hollow elongate coupling rod.

In some embodiments of the present invention, the magnetic disc comprises a second degree of freedom of movement rotationally around a central axis of the hollow elongate coupling rod.

In some embodiments of the present invention, the first degree of freedom of movement comprises a distal termination point at the distal end of the hollow elongate coupling rod and a proximal termination point at a proximal end of the hollow elongate coupling rod.

In some embodiments of the present invention, the hollow elongate coupling rod comprises an outer shell defining a coupling rod cavity, and the outer shell terminates into a crimped lip at the proximal end of the hollow elongate coupling rod.

In some embodiments of the present invention, the gripping structure comprises a gripping structure cavity and an elongate vent.

In some embodiments of the present invention, the elongate vent extends from a distal end of the gripping structure cavity to a distal end of the gripping structure.

In some embodiments of the present invention, the elongate vent is in fluid air communication with a coupling rod cavity of the hollow elongate coupling rod.

In some embodiments of the present invention, the brush cavity comprises a proximal cavity portion and a distal cavity portion.

In some embodiments of the present invention, the proximal cavity portion comprises a proximal portion of the shaft body, and the distal cavity portion comprises a distal portion of the shaft body and a proximal portion of the hollow elongate coupling rod.

In some embodiments of the present invention, the proximal and distal cavity portions each comprise a cylindrical shape, and the proximal cavity portion comprises a larger cavity diameter value than that of the distal cavity portion.

In some embodiments of the present invention, a proximal end of the shaft body comprises a hexagonal shape.

In some embodiments of the present invention, a distal end of the shaft body comprises a tapered tip shape.

In some embodiments of the present invention, a central portion of the shaft body is disposed between the proximal and distal ends of the shaft body, and the central portion of the shaft body comprises a cylindrical shape.

In some embodiments of the present invention, a rotatable electric brush device is provided comprising a handle portion disposed at a proximal end of the rotatable electric brush device, wherein: the handle portion comprises a hollow handle body having a handle exterior surface defining a handle cavity within the handle body, the handle cavity comprises a portion of a driveshaft disposed therein, wherein the driveshaft is coupled to an electronic drive unit at a proximal end of the driveshaft, the electronic drive unit is electronically coupled to a drive actuator that is not covered by the handle exterior surface, a distal end of the driveshaft is not contained within the handle cavity and is not covered by the handle exterior surface, and the distal end of the driveshaft comprises an inner sheath partially defining an engagement cavity; and a brush portion disposed at a distal end of the rotatable electric brush device, wherein: the brush portion comprises a hollow brush body having a brush exterior surface defining a brush cavity within the brush body, the brush cavity comprises a proximal cavity portion and a distal cavity portion, the proximal and distal cavity portions each comprise a cylindrical shape, the proximal cavity portion comprises a larger cavity diameter value than that of the distal cavity portion, the brush cavity comprises a shaft body and a portion of a secondary handle disposed therein, the secondary handle comprises a hollow elongate coupling rod at a proximal end of the secondary handle and a gripping structure at a distal end of the secondary handle, and the brush exterior surface comprises a plurality of bristles extending outward therefrom In some embodiments of the present invention, a rotatable electric brush device is provided comprising a handle portion disposed at a proximal end of the rotatable electric brush device, wherein: the handle portion comprises a hollow handle body having a handle exterior surface defining a handle cavity within the handle body, the handle cavity comprises a portion of a driveshaft disposed therein, wherein the driveshaft is coupled to an electronic drive unit at a proximal end of the driveshaft, the electronic drive unit is electronically coupled to a drive actuator that is not covered by the handle exterior surface, a distal end of the driveshaft is not contained within the handle cavity and is not covered by the handle exterior surface, and the distal end of the driveshaft comprises an inner sheath partially defining an engagement cavity; and a brush portion disposed at a distal end of the rotatable electric brush device, wherein: the brush portion comprises a hollow brush body having a brush exterior surface defining a brush cavity within the brush body, the brush cavity comprises a shaft body and a portion of a secondary handle disposed therein, a proximal end of the shaft body comprises a hexagonal shape and a distal end of the shaft body comprises a tapered tip shape, the secondary handle comprises a hollow elongate coupling rod at a proximal end of the secondary handle and a gripping structure at a distal end of the secondary handle, the gripping structure comprises a gripping structure cavity and an elongate vent, and the brush exterior surface comprises a plurality of bristles extending outward therefrom.

Exemplary embodiments of the present invention are illustrated in the accompanying figures. As shown in FIG. 1, a cross-sectional view of a brush portion 100 of a rotating electric brush device is provided. The brush portion 100 may be a distal element of the rotating electric brush device and may be removably coupled to a proximal element (i.e. a handle portion) of the rotating electric brush device. The term "removably couple" and related or grammatically-adjacent terms (as used throughout this disclosure) implies that two or more elements may be iteratively coupled together in a secure manner robust to accidental separation and yet still removable from one another when desired by a user having the average pull force strength of a small child or very elderly user.

In any instances where the pull force required to separate the brush portion 100 from the handle portion exceeds the pull force capacity of the user, a horseshoe-shaped pry bar may the utilized. The pry bar may comprise an elongate leveraging handle at a proximal end and the horseshoe-shaped prying element at a distal end. The prying element may taper down to a point at a distal terminus to allow the prying element to be inserted between the coupling point of the handle portion and the brush portion 100 which then allows the user to apply leverage to the leverage bar and separate the handle portion from the brush portion 100. The pull force required to separate the brush portion 100 from the handle portion may exceed the pull force capacity of the user in circumstances including where wood fabrication material is utilized and the wood has either expanded or contracted under environmental conditions thereby creating increased frictional engagement between the handle portion and the brush portion 100. The pry bar may be removably coupled to any portion of the brush device including the handle portion or the brush portion 100, but is preferably coupled to the exterior surface of the handle portion or tethered to a structural element thereof.

The brush portion 100 may comprise a brush body 110, a brush shaft 120, a secondary handle 130 and a plurality of bristles 140. The brush body 110 may comprise an interior cavity that is at least partially filled by the brush shaft 120 and the secondary handle 130. Further, the brush shaft 120 and the secondary handle 130 may be removably coupled together within the interior cavity. Additionally, the brush body 110 may comprise an exterior surface that comprises a plurality of bristles 140 extending symmetrically outward therefrom. The brush body 110, therefore, may be hollow in nature and the exterior surface may define the interior cavity.

Specifically, the interior cavity of the brush body 110 may comprise a proximal cavity 112 that partly defines a sheath 116 at the distal end of the brush body 110. The proximal cavity 112 may further house a distal tip of the brush shaft 120 and may generally be shaped as a cylindrical cavity that is disposed at the proximal terminus of the distal cavity 114. The distal cavity 114 may also have a cylindrical shape similar to the proximal cavity 112, but the proximal cavity 112 may comprise a cylindrical shape with a larger diameter dimension than the distal cavity 114 while the distal cavity 114 may comprise a larger length dimension than the proximal cavity 112. These differentials in dimensional proportions between the proximal and distal cavities 112, 114 are advantageous to utilize as they provide a robust coupling means between the brush portion 100 and the handle portion illustrated in FIG. 4. Further, these dimensional relationships also provide the necessary structure allowing the brush shaft 120 and the secondary handle 130 to removably couple together with the desired movement tolerance of the secondary handle 130.

The distal cavity 114 may traverse the majority of the length of the brush body 110 from the distal terminus of the brush body 110 to at least the midpoint of the brush body 110. The proximal terminus of the distal cavity 114 may define the beginning, or distal terminus, of the proximal cavity 112. This transition between the proximal and distal cavities 112, 114 defines the structure of the sheath 116 of the brush body 110. The sheath 116 partly defines the proximal cavity 112 and is further utilized to provide a means of removably coupling the brush portion 100 to the handle portion of FIG. 4 in a manner that is robust to accidental decoupling between the brush and handle portions but yet is still easily decoupled when desired by the user.

The brush shaft 120 may comprise a shaft body 122 having a proximal terminus extending through the proximal cavity 112 and a distal terminus in the form of a tapered tip 124 within the distal cavity. The entire structure of the brush shaft 120 may be stationary within the interior cavity of the brush body 110 and robustly secured therein via frictional engagement with the interior of the brush body 110 defining the interior cavity as shown in FIG. 1. Further, the brush shaft 120 may be stationary relative the brush body 110 in all degrees of movement including rotational and translational movement. It is advantageous that the brush shaft 120 be positionally fixed relative the brush body 110 in a robust manner as the brush shaft 120 functionality is to apply torque received from the handle portion of FIG. 4 to the brush body 110. Therefore, relative movement between the brush body 110 and brush shaft 120 would degrade the functionality of the brush device as a whole.

The shaft body 122 may comprise a generally cylindrical shape that is dimensionally similar or substantially equal to that of the interior cavity of the brush body 110. The tapered tip 124 extending from the cylindrical shaft body 122 may be shaped to taper towards its distal terminus and to an extent that the terminus of the tapered tip 124 comprises a smaller diameter than the proximal terminus of the secondary handle 130. Such a structural relationship between the tapered tip 124 and the secondary handle 130 allows the tapered tip 124 to be partially inserted into a proximal end of an interior cavity of the secondary handle 130. This partial insertion causes a magnetic disc 134 to first magnetically couple to the tapered tip 124 and then to be pushed further towards the lateral middle of the interior cavity of the secondary handle 130 as shown in FIG. 1.

The movement of the magnetic disc 134 within the interior cavity of the secondary handle 130 allows for a lateral movement tolerance of the secondary handle 130 after it is magnetically coupled to the tapered tip 124 via the magnetic disc 134. The lateral movement tolerance allows for the user to select an optimal grip upon a gripping structure 132 that best suits the specific manner in which the user chooses to hold the brush device. While the shape of the gripping structure 132 can be varied to many different shapes, providing a lateral movement tolerance provides another variable by which the user can select the optimal grip for ease of use of the brush device. Additionally, the lateral movement tolerance provides an added user experience benefit of creating an audible clicking noise upon magnetically coupling of the magnetic disc 134 to the tapered tip 124. The audible click provides the user with confidence that the secondary handle 130 is fully inserted within the interior cavity of the brush body 110 and coupled to the brush shaft 120. This increased user confidence in the given functionality is important considering the coupling of the secondary handle 130 to the brush shaft 120 takes place out of sight of the user within the interior cavity of the brush body 110 as shown in FIG. 1.

While the gripping structure 132 is illustrated in FIG. 1 as being substantially spherical, it is understood that FIG. 1 encompasses the use of a gripping structure 132 having an alternate shape such as, but not limited to, cylindrical, rectangular, at least partially sinusoidal, ovular and the like or any combination thereof. It would be advantageous for the gripping structure 132 to have a structure with at least some curvature such as that of a spherical, cylindrical, ovular shape and the like in order to provide a shape that conforms to the contours of a user's hand for an optimized grip while the brush body 110 and the brush shaft 120 rotates independently. The gripping structure 132 may be permanently affixed to a coupling rod 136 of the secondary handle 130 such that the gripping structure 132 does not move relative the coupling rod 136. However, both of the gripping structure 132 and the coupling rod 136 may move and rotated relative the magnetic disc 134 which thereby allows the magnetic disc 134 to rotate with the brush shaft 120 upon coupling to the tapered tip 124. Consequently, the gripping structure 132 and the coupling rod 136 may move and rotate independently of the brush body 110 and the brush shaft 120 which thereby allows the user to grip the secondary handle 130 while the rest of the brush portion 100 is being rotated by the handle portion of FIG. 4. Therefore, the coupling rod 136 may comprise a diameter that is smaller than that of the distal cavity 114 to provide a gap therebetween (as shown in FIG. 1) so as to minimize any potential rotational friction between the rod 136 and the interior surfaces of the brush body 110. The gripping structure 132 may also be able to independently rotate relative the remainder of the secondary handle 130, the brush body 110 and the brush shaft 120 by utilizing a rotational bearing between the gripping structure 132 and the remainder of the secondary handle 130 including the coupling rod 136.

Figure 2:
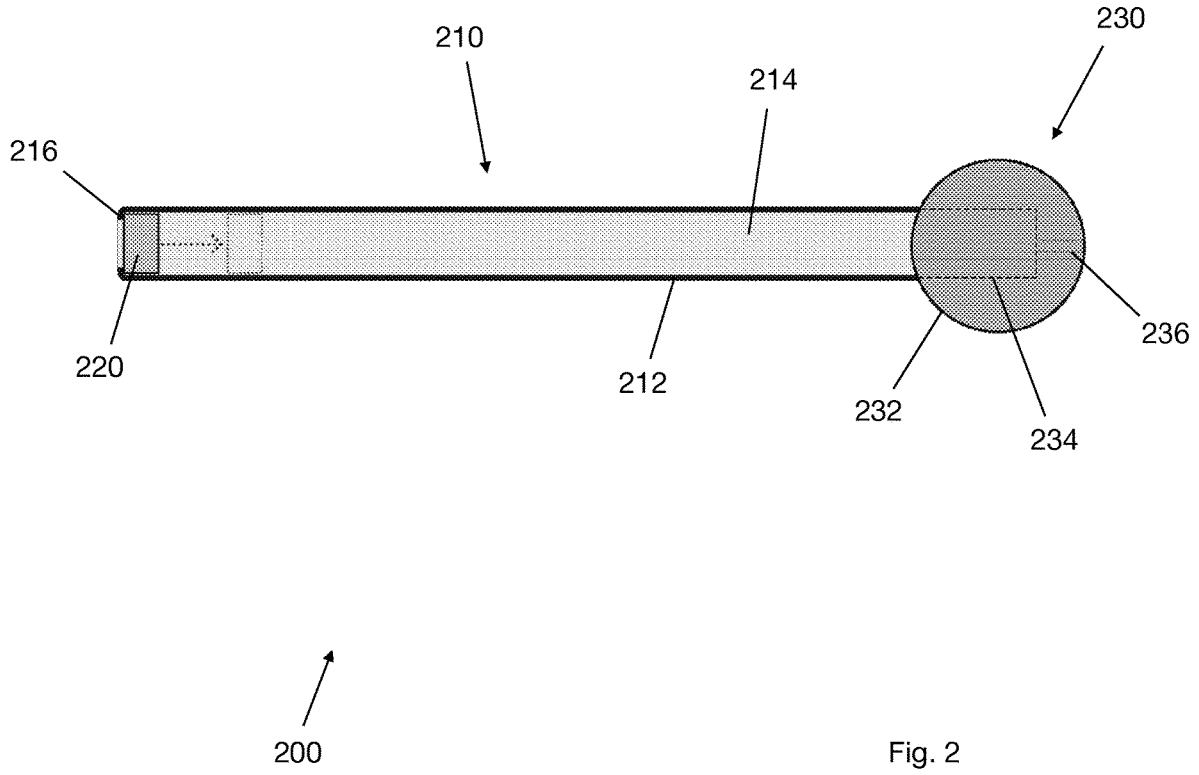
FIG. 2 illustrates a detailed view of a secondary grip of a brush portion of a rotating electric brush device in accordance with some embodiments of the present invention.

Given the aforementioned functionality, it is advantageous that the coupling rod 136 be fabricated in the shape of a hollow cylinder from a metallic material that is polished on its outer surface in order to minimize rotational friction between the outer surface of the coupling rod 136 and the interior surface of the brush body 110 as the brush body 110 rotates independently therefrom. Additionally, the proximal terminus of the coupling rod 136 may comprise a crimped edge that crimps the proximal edge of the rod 136 so that the edge curves inward into back into the interior cavity within the rod 136 as illustrated in FIG. 2. This curved crimped design (along with the polished exterior) of the coupling rod 136 at the coupling interface with the tapered tip 124 ensures that any rotational friction between the structural interface is minimized for maximum applied torque to the brush portion 100.

The magnetic disc 134 may comprise an orthogonal separation force when magnetically coupled with the tapered tip 124 that at least bears the weight of the entirety of the secondary handle 130. Preferably, the orthogonal separation force value bears at least twice the weight of the entirety of the secondary handle 130 in order to provide some tolerance for error by the user when gripping the secondary handle 130 during use of the brush device against an animal surface while not creating a burden for the user to decouple the secondary handle 130 from the tapered tip 124. During decoupling, the crimped proximal edge of the coupling rod 136 may retain the magnetic disc 134 within the interior cylindrical cavity of the rod 136. Further, the diameter of the magnetic disc 134 may be similar or substantially the same as that of the interior cylindrical cavity so as to retain the magnetic disc 134 in the vertical orientation shown in FIG. 1 which controls for variability in user experience iteratively magnetically coupling the brush shaft 120 to the secondary handle 130.

The brush portion 100 may further comprise a plurality of bristles 140 extending outwards from the exterior surface of the brush body 110 as shown in FIG. 1. The quantity, shape, orientation and size of the bristles 140 may be altered according to what is best suited for the fur or hair of the animal to be brushed. In use, the brush device may utilize a plurality of brush portions 100 each having a unique set of bristles 140 that are designed to accommodate the fur or hair type of that specific animal. Thereby, a user may utilize, for instance, a first brush portion having a first set of bristles designed for brushing their pet cat and later decouple the first brush portion from the handle portion and attach a second brush portion thereto having a second set of bristles designed for brushing their pet dog. Similarly, a brush portion having any type of bristles may be removably coupled to the handle portion of the brush device in order to accommodate the unique needs of any commercial or residential animal requiring regular grooming.

In some embodiments, there may be an actuator disposed within the brush portion 100 that allows for retraction of the plurality of bristles 140 into a stowed state within the brush body 110 and thereafter deployment of the bristles 140 back out of the brush body 100 into an extended state. Such functionality allows for animal fur or hair collected in the plurality of bristles 140 to be easily removed from the exterior surface of the brush body 110 upon actuation of the bristles 140 into the stowed state. Specifically, as animal hair is collected by the bristles 140, it is common for it to be wrapped around the cylindrical brush body 110 in a circumferential manner which makes removal of such hair very burdensome and time-consuming. By retracting the bristles 140 into the stowed state, the wrapped hair may be easily removed from the brush body 110 by sliding the wrapped hair across the surface of the brush body 110 until the wrapped hair is slid off of the brush body 110 entirely. Thereafter, the bristles 140 may be actuated back out into their extended state for further use.

As shown in FIG. 2, a detailed view of a secondary handle 200 of a brush portion of a rotating electric brush device is provided. The secondary handle 200 may comprise a coupling rod 210, a magnetic disc 220 and a gripping structure 230. The coupling rod 210 may comprise an outer cylindrical shell 212 defining an internal cavity 214. The distal terminus of the outer cylindrical shell 212 may have the gripping structure 230 coupled thereto. The proximal terminus of the outer cylindrical shell 212 may comprise an inwardly crimped lip 216.

The inwardly crimped lip 216 may retain the magnetic disc 220 within the internal cavity 214 at the proximal terminus of the coupling rod 210 and the gripping structure 230 may retain the magnetic disc 220 within the internal cavity 214 at the distal terminus of the coupling rod 210. The crimped lip 216 may be defined by the inwardly projecting terminal edge of the outer cylindrical shell 212 which may project inwardly at a roughly 90 degree angle relative the outer shell 212 as shown in FIG. 2. Alternatively, the crimped lip 216 may project inwardly at angles greater than 90 degrees relative the outer shell 212. It is advantageous that the crimped lip 216 project inward at angles of between 90 and 180 degrees as this will present a rounded surface against the outer surface of the tapered tip 124 of FIG. 1 and thereby reduce rotational friction between the crimped ip 216 and the tip 124.

Therefore, the magnetic disc 220 is allowed to translate within the internal cavity 214 in one lateral degree of freedom between the proximal and distal terminal ends of the coupling rod 210. The dimensions of the magnetic disc 220 are such that the diameter of the disc 220 is similar or substantially equal to that of the internal cavity 214 and the length of the disc 220 is long enough so as to keep the disc 220 in the upright vertical orientation shown in FIG. 2. In other words, the corner-to-corner dimensional value of the disc 220 (i.e. the hypotenuse value of the diameter and length values of the disc 220) is advantageously larger than the diameter of the internal cavity 214.

While the gripping structure 230 is illustrated in FIG. 2 as being substantially spherical, it is understood that FIG. 2 encompasses the use of a gripping structure 230 having an alternate shape such as, but not limited to, cylindrical, rectangular, at least partially sinusoidal, ovular and the like or any combination thereof. Further, it is advantageous that the gripping structure 230 not rotate independently of the coupling rod 210 but also that the magnetic disc 220 is allowed to rotate independently of both the coupling rod 210 and the gripping structure 230. This configuration advantageously allows the user to grip the secondary handle 200 via the gripping structure 230 while the rest of the brush portion is being rotated by the handle portion of FIG. 4.

The gripping structure 230 may comprise a body 232 that defines a cavity 234 therein. The cavity 234 may be shaped to accommodate the distal end of the coupling rod 210 and outer shell 212. Further, the cavity 234 may terminate at its proximal end in an opening within the proximal end of the body 232 that is shaped to accept the distal end of the coupling rod 210. The cavity 234 may terminate at its distal end in an elongate vent 236 that may be in fluid air communication with the internal cavity 214 of the coupling rod 210 when it is inserted into the cavity 234. The elongate vent 236 may terminate at its distal end in an opening within the distal end of the body 232.

It is advantageous to utilize the elongate vent 236 in order to provide a free exchange of fluid air between the external environment and the fluid air within the internal cavity 214 which allows the magnetic disc 220 to freely translate axially within the internal cavity 214 without incurring significant fluid air resistance that would prevent free translation. Given the diameter of the magnetic disc 220 may be substantially equal or very similar to the diameter of the internal cavity 214, air pressure may build up as the magnetic disc 220 attempts to translate therethrough without any means for such built-up pressure to be released. This elongate vent 236 allows the magnetic disc 220 to freely translate within the internal cavity 214 and thereby provide the full aforementioned functionality of the secondary handle 200.

Figure 3:
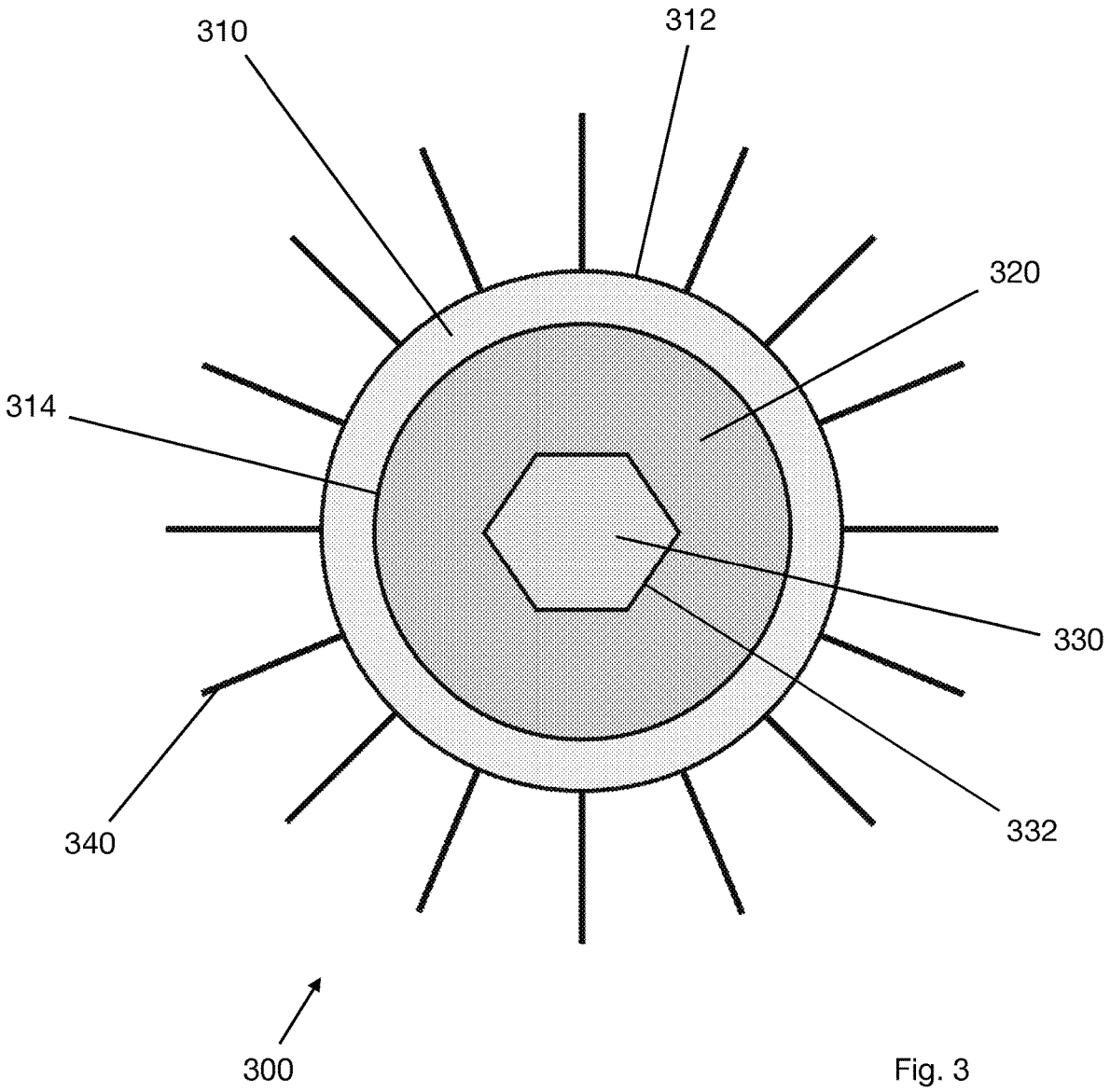
FIG. 3 illustrates a cross-sectional view of a proximal end of a brush portion of a rotating electric brush device in accordance with some embodiments of the present invention.

As shown in FIG. 3, a cross-sectional view of a proximal end of a brush portion 300 of a rotating electric brush device is provided. The brush portion 300 may comprise brush body 310 having an outer surface 312 and an inner surface 314. The outer surface 314 may define an internal cavity 320 through which a brush shaft 330 may pass. The brush shaft 330 may comprise a plurality of engagement facets 332 disposed at the exterior surface of the brush shaft 330. The engagement facets 332 are designed to engage in a press fit manner with complimentary structures of the handle portion of FIG. 4.

The outer surface 312 of the brush body 310 may secure a plurality of bristles 340 therein. The plurality of bristles 340 may extend radially outward from the outer surface 312 in a manner such that each of the bristles 340 may be extend in a direction that is orthogonal to the plane of the outer surface 312 as shown in FIG. 3. The quantity, shape, orientation and size of the bristles 340 may be altered according to what is best suited for the fur or hair of the animal to be brushed. Further, in the same manner as discussed with regard to FIG. 1, the bristles 340 may be iteratively retracted into the brush body 310 and deployed therefrom as desired by the user via manual actuation of an actuator that manipulates the bristles 340 between the stowed state and the extended state.

Figure 4:
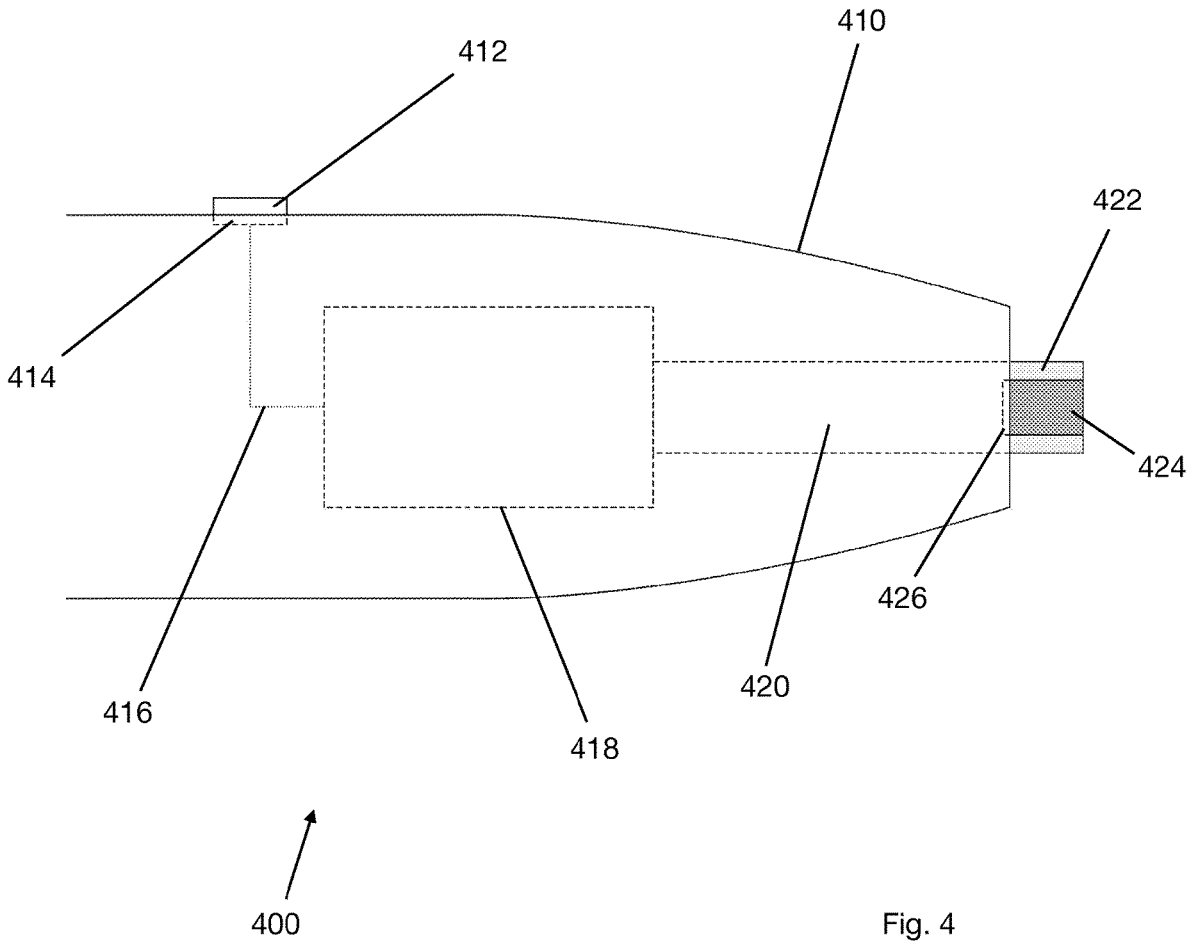
FIG. 4 illustrates a partial cross-sectional view of a handle portion of a rotating electric brush device in accordance with some embodiments of the present invention.

As shown in FIG. 4, a partial cross-sectional view of a handle portion 400 of a rotating electric brush device is provided. The handle portion 400 may comprise a handle body 410 having an exterior surface that may comprise a cylindrical shape at a proximal end of the body 410. The cylindrical shape may then taper inwardly into a conical shape towards the distal end of the handle body 410. Such a shape may be advantageous in allowing the user multiple grip diameters along the handle body 410 with which to grasp the handle portion 400 while using the rotating electric brush device to groom an animal. The handle body 410 may therefore be hollow in nature such that that exterior surface defines a cavity therein as shown in FIG. 4.

An actuator 412 may be partially disposed within the exterior surface of the handle body 410. The actuator 412 may partially extend from the exterior surface of the body 410 and may be actuated further into the interior of the body 410. Upon being fully depressed into the interior of the handle body 410, the actuator 412 in the depressed state may be disposed within a sensor region 414 which triggers a drive signal to be provided to the electronic drive unit 418 via a communication line 416. The actuator 412 may be manually depressed by the user by applying a downward force thereto against the restorative force of one or more springs that maintain the actuator 412 in a spring-loaded extended state. When the user releases the downward force from the actuator 412, the restorative force of the one or more springs may then restore the actuator 412 back into the extended state. Upon the actuator 412 being removed from the sensor region 414 via the spring, the drive signal to the electronic drive unit 418 may be terminated.

When the drive signal is active to the electronic drive unit 418 via the communication line 416, a rechargeable wireless power source within the unit 418 may deliver electric power signals to an electric motor within the unit 418 which in turn provides torque to a driveshaft 420 of the handle portion 400. The rechargeable wireless power source may be a lithium-ion battery or the like. The electric motor may be a brushless low-noise motor system that has a form factor accommodating the shape of the handle body 410.

Further, the electric motor may be communicatively coupled to an electronic control unit which utilizes an auto-shutoff feature that will automatically shut off the electric motor upon detection of an over-torque event or runaway tangling event is detected thereby. The electric motor may operate up to a rotational speed of about 320 revolutions per minute and may provide preset user-selectable speeds at intervals between 0 and 320 revolutions per minute. Such functionality would be advantageous for different hair textures or tasks associated with various commercial and residential animal use cases. Therefore, the maximum rotational speed that the electric motor may rotate the driveshaft at is about 5 revolutions per second.

The driveshaft 420 may comprise a generally elongate shape having a proximal end terminating into engagement with the electric motor of the electronic drive unit 418 and a distal end terminating outside of the handle body 410 as shown in FIG. 4. The distal end of the driveshaft 420 may comprise a sheath 422 partly defined by an engagement cavity 424. The engagement cavity 424 may comprise a magnetic element 426 disposed at the proximal terminus of the cavity 424. The distal terminus of the engagement cavity 424 may comprise an opening that functions to accept a shaft body of a brush portion of the rotation electric brush device as described in FIGS. 1 and 3. Upon accepting the shaft body therein, the magnetic element 426 may provide, along with the frictional engagement between the sheath 422 and the shaft body, an added amount of separation force required to separate the shaft body from coupling connection with the driveshaft 420 structure collectively.

Given the competing desires for the rotating electric brush device to be easy to use but also functionally robust during use, there is an advantageous range of values for the separation force required to separate the shaft body from coupling connection with the driveshaft 420. Specifically, it would be advantageous for the separation force value to fall within the range of 3 pounds and 9 pounds. Any separation force value less than 3 pounds would not provide a coupling between the shaft body and driveshaft 420 that is robust during use. For instance, during use of the device grooming an animal, the brush bristles could get caught on a snag in tangled hair thereby causing a force to be applied to the coupling point that exceeds the provided separation force of less than 3 pounds. Additionally, any separation force value greater than 9 pounds would require a burdensome amount of force from the user in order to decouple the shaft body from the driveshaft 420. For example, children, elderly or disabled users may not be physically able to apply a separation force of greater than 9 pounds which reduces the ease of use of the device overall.

The engagement cavity 424 of the driveshaft 420 may comprise a generally hexagonal shape which is designed to accept a complimentary hexagonal shaft body of the brush portion of FIGS. 1 and 3. While other shapes may be utilized, such as triangular, square, pentagonal, octagonal and the like, hexagonal is preferred as it is advantageous in terms of providing a shape that is easily fabricated from a cylindrically shaped shaft body, unlike a triangular, square or pentagonal shapes. A hexagonal shape provides corner facets that are smaller in angle size than an octagonal shape, for instance, and this provides continued robust engagement during high-torque events while reducing the likelihood, relative the octagonal shape, that the corner facets get stripped over time and no longer retain rotational alignment with the engagement cavity 424.

Consequently, both the sheath 422 of the handle portion 400 and the sheath of the brush portion of FIGS. 1 and 3 may also preferably be hexagonal in shape in order to structurally engage flush with the engagement cavity 424. It is essential that the engagement between these structural items be flush with one another in order to prevent structural wear and tear over time during repeated torque events. Specifically, in order to avoid such structural damage over time, the engagement structures of the brush and handle portions may have a flush fit tolerance of less than 0.75 millimeters when measuring the difference between the outer diameter of the shaft body of FIGS. 1 and 3 and the inner diameter of the sheath 422.

Figure 5:
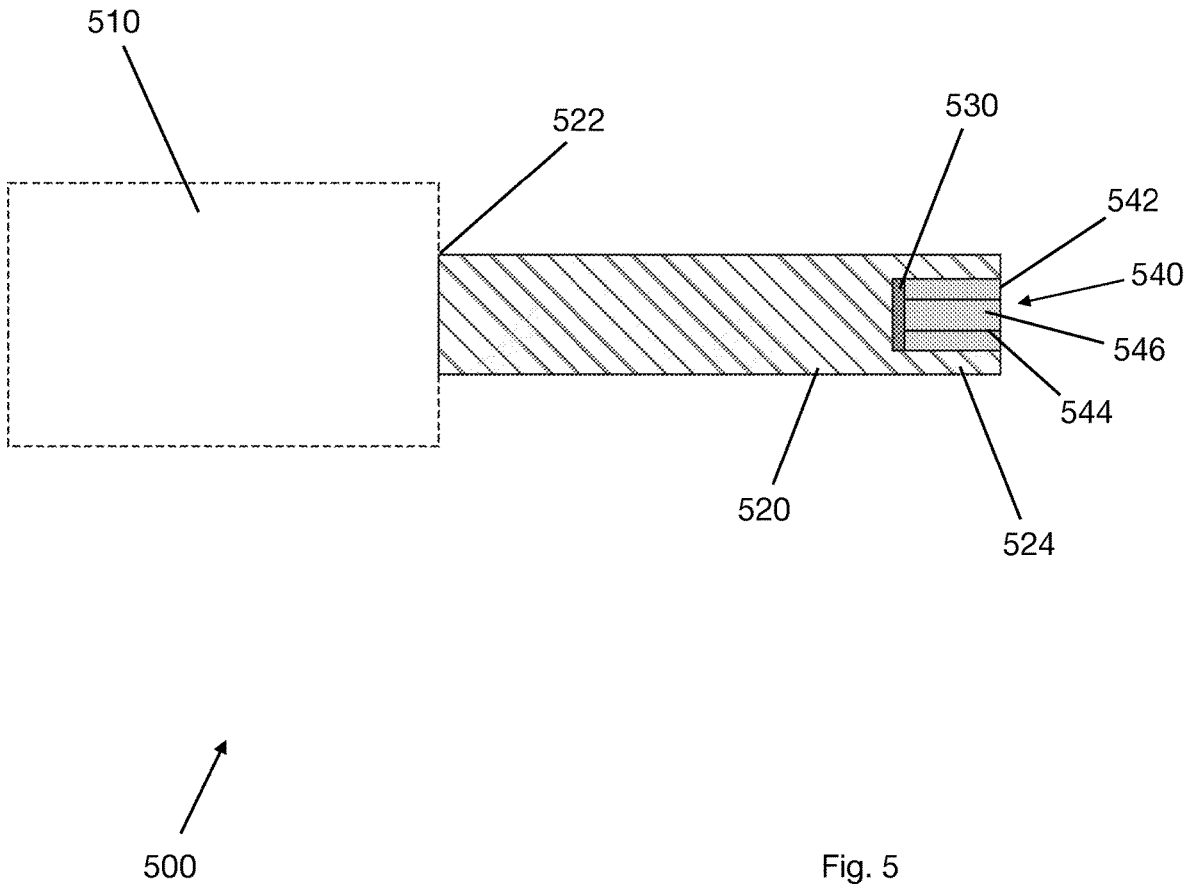
FIG. 5 illustrates a detailed partial cross-sectional view of a shaft drive connector of a handle portion of a rotating electric brush device in accordance with some embodiments of the present invention.

As shown in FIG. 5, a detailed partial cross-sectional view of a shaft drive connector 500 of a handle portion of a rotating electric brush device is provided. The shaft drive connector 500 may comprise an electronic drive unit 510 coupled to a proximal end of a driveshaft 520 at a coupling point 522. The distal end of the driveshaft 520 may comprise a magnetic element 530 disposed within an engagement cavity 540. The magnetic element 530 may be disposed at a proximal end of the engagement cavity 540 while the distal end of the cavity 540 may terminate into an opening 542.

Further, the engagement cavity 540 may be partly defined by the sheath 524 of the driveshaft 520 as shown in FIG. 5.

The engagement cavity 540 may comprise a hexagonal shape that is defined by six successively arranged corners 544 and facets 546 as shown in FIG. 5. The hexagonal shape may be a regular hexagonal shape such that the interior angles defined by each of the corners 544 is very similar or the same relative one another and the surface area of each facet 546 is very similar or the same as each other. Consequently, the hexagonal shape of the shaft body of FIGS. 1 and 3 may also comprise a regular hexagonal shape such that each corner-to-corner width (or diameter) dimension is very similar or the same as each other. However, the magnetic element 530 need not necessarily be hexagonal in shape. For instance, the shape of the magnetic element 530 may be cylindrical or disc-shaped for ease of manufacture and placement within the engagement cavity 540.

Figure 6:
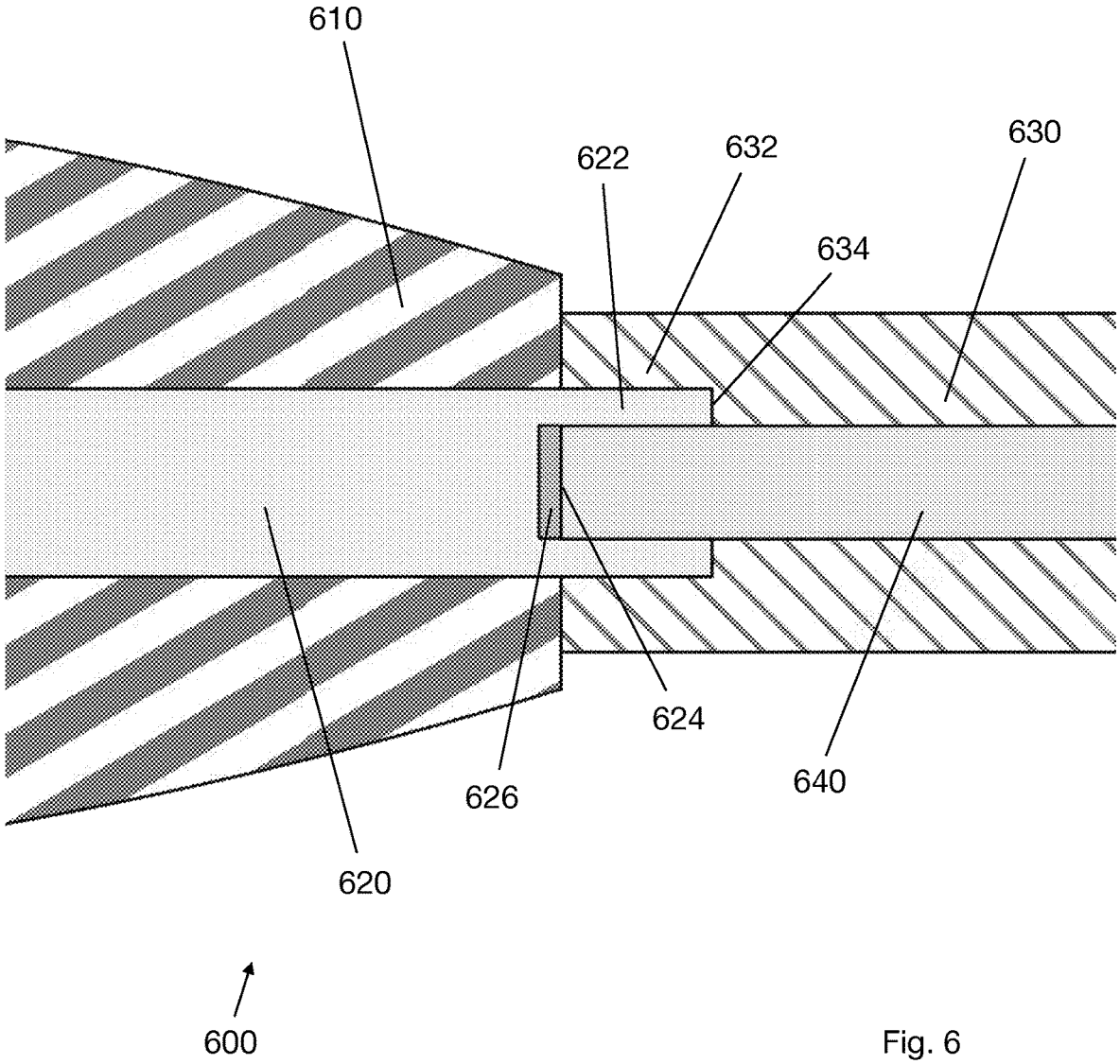
FIG. 6 illustrates a cross-sectional view of a driveshaft of a handle portion removably coupled to a shaft of a brush portion of a rotating electric brush device in accordance with some embodiments of the present invention.

As shown in FIG. 6, a cross-sectional view of a driveshaft 620 of a handle portion removably coupled to a shaft 640 of a brush portion of a rotating electric brush device 600 is provided. The handle portion may comprise a handle body 610 and the driveshaft 620. The driveshaft 620 may comprise an inner sheath 622 partly defining an engagement cavity therein which retains a magnetic element 626 at a proximal terminus thereof as shown in FIG. 6. The brush portion may comprise a brush body 630 having an outer sheath 632 defining an interior proximal cavity therein which appears as an annular cylindrical cavity with the shaft 640 disposed therethrough as shown in FIG. 6. Further, the brush portion may comprise the shaft 640 disposed axially through a central interior cavity of the brush body 630.

When the driveshaft 620 and the shaft 640 are in the engaged state as shown in FIG. 6, the shaft 640 may couple to the magnetic element 626 at a first coupling point 624 such that the shaft 640 is fully inserted within the engagement cavity of the inner sheath 622. Similarly, in the engaged state, the inner sheath 622 of the driveshaft 620 may be in a press fit coupled state with the brush body 630 such that the inner sheath 622 is fully inserted into the interior proximal cavity of the outer sheath 632 at a second coupling point 634. Thereby, the outer sheath 632 may completely surround the inner sheath 622 such that the outer sheath 632 is disposed adjacent the distal terminus of the handle body 610 as shown in FIG. 6.

Figure 7A:
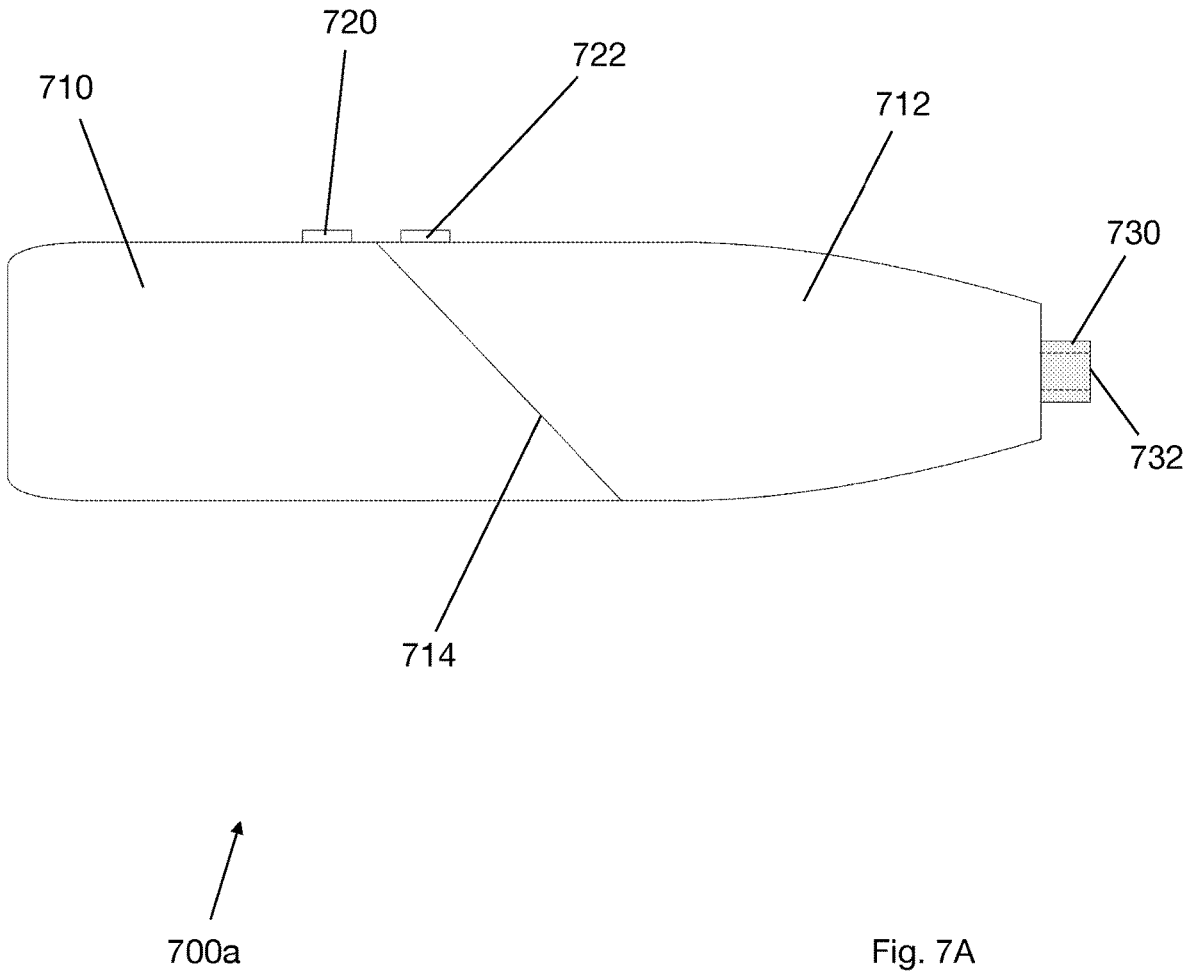
FIG. 7A illustrates a plan view of a handle portion of a rotating electric brush device in an elongate state in accordance with some embodiments of the present invention.

As shown in FIG. 7A, a plan view of a handle portion 700*a* of a rotating electric brush device in an elongate state is provided. The handle portion 700*a* may comprise a proximal portion 710 and a distal portion 712 that are coupled together via an angled joint 714. The proximal portion 710 may comprise a drive actuator 720 that, when actuated, triggers a drive signal to an electronic drive unit within the interior of the handle portion 700*a*. The distal portion 712 may comprise a rotational actuator 722 that, when actuated, allows the proximal portion 710 and the distal portion 712 to rotate relative one another. Specifically, when the rotational actuator 722 is in the depressed state, the angled joint 714 may be placed into an unlocked state thereby allowing the proximal portion 710 to rotate relative the distal portion 712. When the rotational actuator 722 is in a default extended state, the angled joint 714 may be placed into a locked state thereby restricting any rotational movement between the proximal and distal portions 710, 712. It is advantageous to provide rotation between the proximal and distal portions 710, 712 in order to provide a better grasping angle as a sheath 730 and an engagement cavity 732 engage a shaft body of a brush portion to apply torque from the electronic drive unit to the brush portion.

Figure 7B:
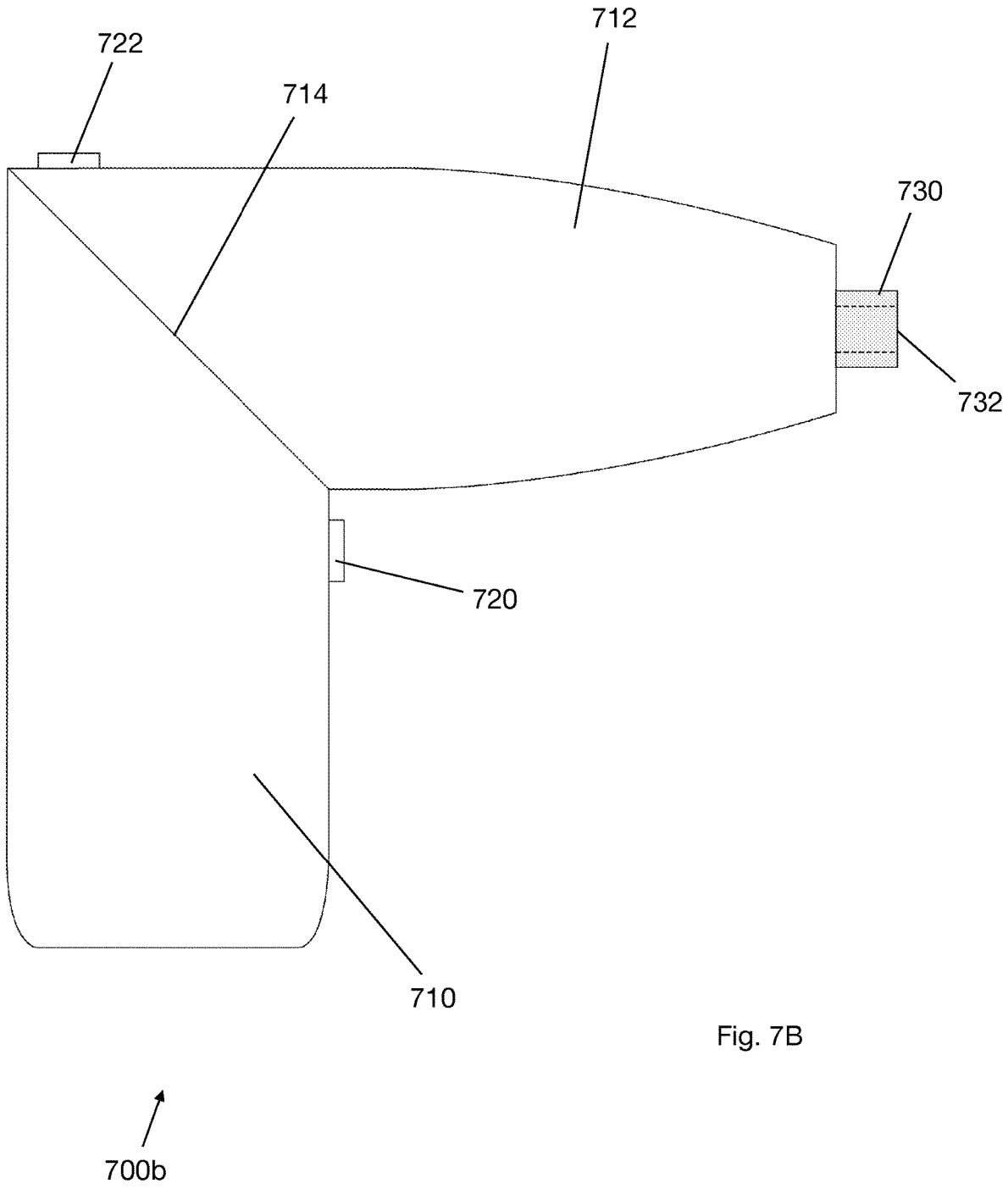
FIG. 7B illustrates a plan view of a handle portion of a rotating electric brush device in an angled state in accordance with some embodiments of the present invention.

As shown in FIG. 7B, a plan view of a handle portion 700*b* of a rotating electric brush device in an angled state is provided. The handle portion 700*b* may be substantially similar from a structural perspective to the handle portion 700*a* described with respect to FIG. 7A. However, FIG. 7B illustrates the handle portion 700*b* in the angled state after the rotational actuator 722 has been depressed to allow the proximal portion 710 to rotate relative the distal portion 712 from the elongate state of FIG. 7A to the angled state of FIG. 7B. Specifically, the elongate state is defined by the proximal and distal portions 710, 712 being axially aligned to form a 180 degree angle therebetween. The angled state is defined by the proximal and distal portions 710, 712 being arranged orthogonally relative one another to form a 90 degree angle therebetween.

Moreover, after the rotational actuator 722 is placed into the depressed state, it may only be placed back into the default extended state when the proximal and distal portions 710, 712 are in the elongate state or the angled state. Specifically, the rotational actuator 722 may not be able to be placed back into the default extended state when the proximal and distal portions 710, 712 are in a relative rotational state anywhere between the elongate and angled states, i.e. when the proximal and distal portions 710, 712 form an angle therebetween anywhere within the range of 90 and 180 degrees, not inclusive. Therefore, the proximal and distal portions 710, 712 may only be in a locked rotational state when the handle portion 700*b* is either in the elongate or angled states and when the rotational actuator 722 is in the default extended state.

Figure 8A:
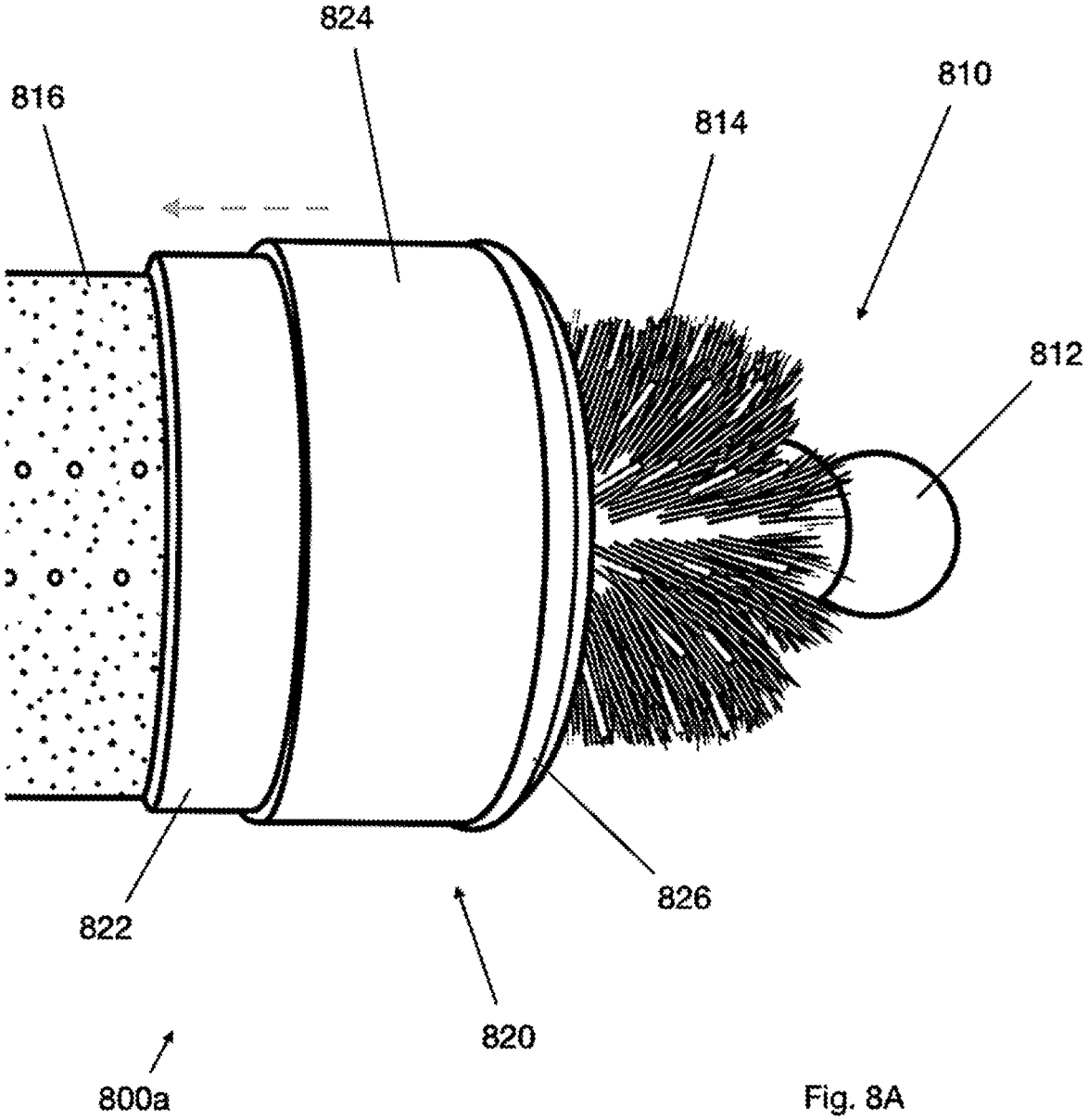
FIG. 8A illustrates an elevational view of a hair removal device 800*a* of a brush portion 810 as it traverses along the length of a brush body in accordance with some embodiments of the present invention.

As shown in FIG. 8A, an elevational view of a hair removal device 800*a* of a brush portion 810 as it traverses along the length of a brush body is provided. The hair removal device 800*a* may comprise a generally cylindrical annular body 820 having a lower portion 822 and an upper portion 824 that collectively define a hollow interior. The outer diameter of the lower portion 822 may be smaller than that of the outer diameter of the upper portion 824. Further, the upper portion 824 may comprise a lip 826 that is structured to be grasped by the hand of a user as the user manipulates the hair removal device 800*a* across the bristles of the brush portion 810 in a direction as illustrated by the dashed arrow in FIG. 8A.

Specifically, to use the hair removal device 800*a*, the user may place the device 800*a* over the brush portion 810 with the lower portion 822 being first inserted over the distal end of the brush portion 810 where a secondary handle 812 is disposed. Thereafter, an array of cleaning prongs (shown in FIG. 8B) disposed upon an interior surface of the annular body 820 may clean the bristles as they translate thereacross and thereby remove the hair therefrom. As shown in FIG. 8A, the hair removal device 800*a* leaves clean bristles 814 without any hair caught therein in the areas it has already passed over as to moves towards the dirty bristles 816 that it hasn't yet reached.

It is advantageous that the inner diameter of the annual body 820 be substantially equal or very similar to the outer diameter of the circumferentially-arranged bristles of the brush portion 810. Such a structural relationship allows the array of cleaning prongs to project toward a brush body from which the bristles extend which allows the prongs to dig into the bristles and collect the hair therefrom. Further, it is advantageous that the upper portion 824 comprise the lip 826 in the outwardly-protruding shape shown in FIG. 8A as this increased the surface area upon which the user may exert force to manipulate the hair removal device 800*a* through the bristles laterally along the length of the brush portion 810.

Figure 8B:
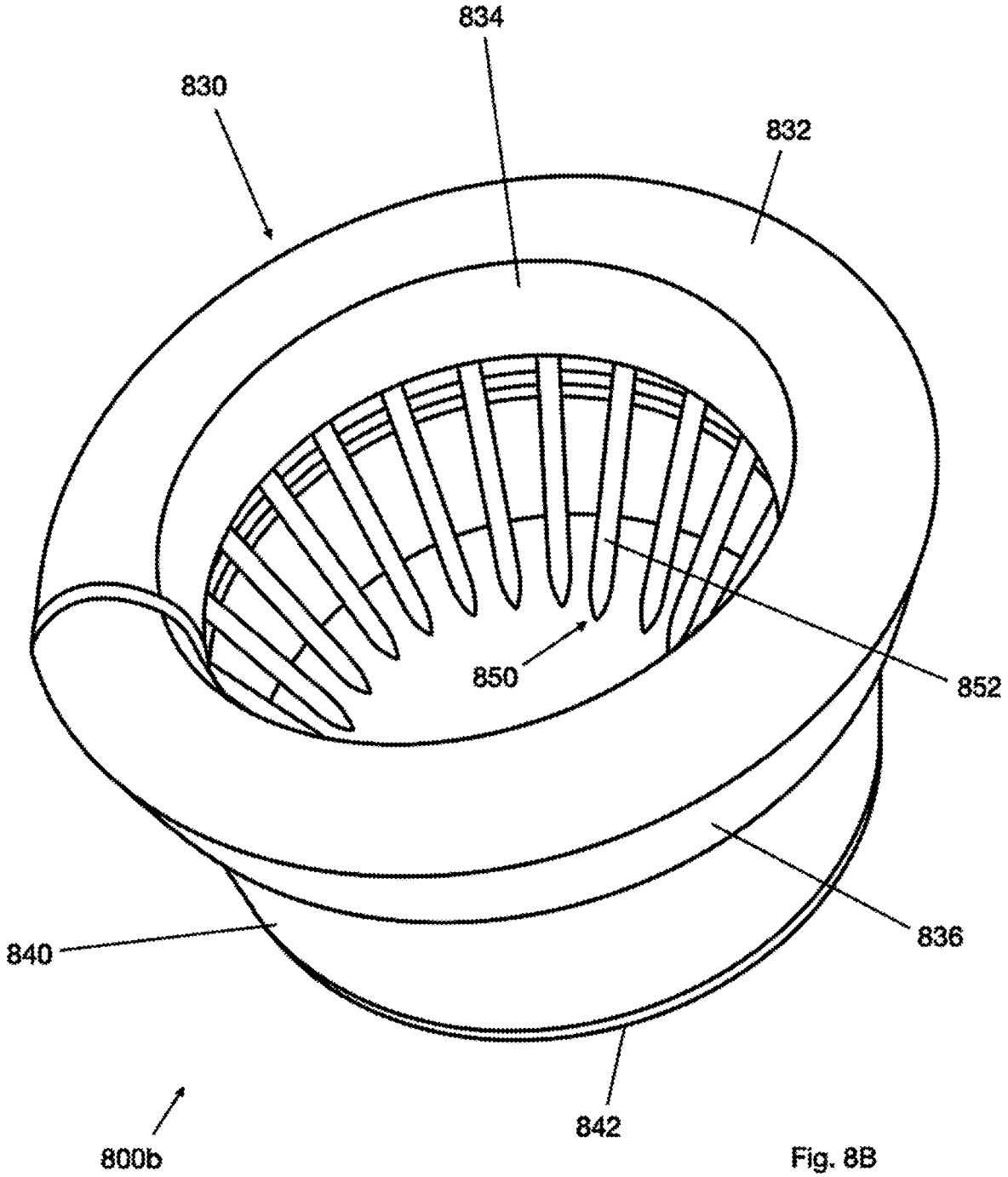
FIG. 8B illustrates a detailed perspective view of a hair removal device 800*b* of a brush portion in accordance with some embodiments of the present invention.

As shown in FIG. 8B, a detailed perspective view of a hair removal device 800*b* of a brush portion is provided. The hair removal device 800*b* may comprise a gripping portion 830 having an upper lip 832 that couples to an upper portion 840 via interior and exterior surfaces 834, 836 as shown in FIG. 8B. The upper portion 840 may comprise a lower portion 842 such that the outer diameter of the upper portion 840 is greater than that of the lower portion 842. Further, an array of cleaning prongs may be disposed from the annular coupling seam between interior surface 834 and an inner surface of the upper portion 840. Each of the cleaning prongs in the array may comprise a stem 852 and a tip 850. The proximal end of each stem 852 may attach to the annular coupling seam while the distal end of each stem 852 may taper towards a point which defines the tip 850.

Additionally, the array of cleaning prongs may extend from the annular coupling seam in an angled downward manner that forms an acute angle with the inner surface of the upper portion 840. Specifically, the acute angle formed may be within the range of 15 degrees to 50 degrees. Angles less than 15 degrees would not allow the tips 850 of the cleaning prongs to penetrate deep enough into the bristles of the brush portion to effectively clean the bristles of hair. Angles greater than 50 degrees may not provide enough structural integrity for the cleaning prongs to be robust against the pull force exerted by the hair tangled into the bristles. For instance, if the cleaning prongs angle out too far, i.e. beyond 50 degrees, then they may bend under the component force applied by the tangled hair to the increased cleaning prong surface area exposed by the large protrusion angle.

When the hair removal device 800*b* is translated along the length of the brush portion, the bristles immediately adjacent the array of cleaning prongs may be manipulated into an angular position such that they are no longer orthogonal to the brush portion. Further, the brush body may be angled inward toward a bottom portion thereof in order to facilitate the bending of the bristles which itself facilitates capture of the hair within the bristles by the array of cleaning prongs.

Moreover, the number and physical arrangement of the array of cleaning prongs also is important. Specifically, the number of cleaning prongs utilized may be commensurate with or proportional to the outer diameter of the bristles as they extend from the brush body. A larger number of cleaning prongs will be required for increasing bristle outer diameters. Further, the cleaning prongs should be arranged in a symmetric manner about the coupling seam. This ensures that the cleaning prongs do not miss any hair tangled within the bristles and also that the hair collected forms a neatly organized ring of hair that is easily removed from the array of cleaning prongs as desired by the user.

In some embodiments of FIGS. 1-8B, the handle portion of the rotatable electric brush device may comprise an exterior surface having a generally elongate cylindrical shape that comprises a circumference value that is at least the length of an average user's hand. Further, the exterior surface may comprise contoured gripping structures fabricated into the shape of the exterior surface. The gripping structures may be shaped to fit the contour of the average user's palm and fingers when wrapped around the exterior surface of the handle portion. Specifically, the gripping structures may comprise a plurality of successive depressions arranged in parallel that are shaped to conform to the shape of human fingers wrapped around the handle portion. Additionally, the gripping structures may comprise a layer of high-friction material that assists the user in firmly gripping the handle portion.

In some embodiments of FIGS. 1-8B, the engagement cavity of the handle portion (as defined by the inner sheath) may take the form of a hex bit holder to receive a corresponding hex bit of the shaft body. The width dimensions of the hex bit holder and hex bit may fall within a range of ⅛ inch to 1 inch, where the choice of width value may be determined by the size of the brush portion being utilized. Typically, the size of the brush portion and associated bristles may be determined by the size of the animal to be groomed. Similarly, the size, shape and arrangement of bristles may be selected based upon the type of hair of the animal to be groomed.

Advantageously, a first brush portion with a first set of bristles may be modularly replaced with a second brush portion with a second set of bristles as desired by the user. The various sets of bristles may comprise multi-layered, cross-sectionally layered, diagonally layered and alternating bristle length configurations and the like which are each individually suited to specific animal hair types and tasks. The various bristle configurations may be utilized to collect, store, remove, fluff, lift, separate, sweep or shampoo the animal hair.

In some embodiments of FIGS. 1-8B, the rotatable electric brush device is intended to develop a therapeutic grooming routine for an animal that is unable, or unwilling, to clean themselves, all while forming a bond with the groomer and providing relief and pleasure for the animal. The brush device allows removal of flea debris, fleas, pests and most other foreign matter in and under the fur or hair of an animal and, specifically, can minimize random urination in cats. The brush device is designed to massage the skin which increases blood flow and stimulating natural oils within the animal while maintaining hair and skin health of the animal. The brush device may remove more than twice the hair with one brush stroke relative the conventional hand brush.

In some embodiments of FIGS. 1-8B, the brush portion may comprise an accessory attachment in the form an acoustic noise-canceling vacuum shield with an internal HEPA filter. The vacuum shield can be added as an attachment via coupling to any non-rotating structural element of the rotatable electric brush device such as the exterior surface of the handle portion or the secondary handle of the brush portion. The vacuum shield may fluidically communicate via vacuum suction with any existing built-in vacuum removal systems. Use of such a vacuum suction attachment with the rotatable electric brush device may reduce contamination of the surrounding environment with hair dander, shed hair and acoustic noise.

In some embodiments of FIGS. 1-8B, the bristles of the brush portion may be retractable in nature into and out of the exterior surface of the brush body. A rotational, radial or axial (relative the length of the brush portion) actuation motion of an actuator may be employed to cause the bristles to retract within and extend from the brush body as desired by the user. The actuator may be provided as an annular actuator that rotates around at least a portion of the brush body, as a pull-tab actuator that translates radially into and out of a portion of the brush body, or as a slide actuator that translates axially back and forth along a portion of the brush body. This structure and functionality allows animal hair collected upon and within the brush body and bristles to be easily removed without the impediment of picking the hair out from around the bristles themselves.

In some embodiments of FIGS. 1-8B, the magnetic elements of both of the handle portion and the brush portion may be fabricated from one or more magnetic materials including, but not limited to, iron, aluminum, nickel, cobalt, strontium carbonate, barium oxide, iron oxide, neodymium, gadolinium, dysprosium and the like or any combinations thereof.

In some embodiments of FIGS. 1-8B, both the coupled inner and outer sheath portions and the secondary handle portion of the rotating electric brush device may be utilized for edge brushing of the animal surface at the joints, neck and other bodily crevices of the animal without incurring harm or discomfort to the animal. Specifically, by utilizing both the handle portion and the secondary handle when grooming an animal, the animal may adjust their bodies into the positions that best suits their grooming needs without the user having to guess in which areas the animal wants grooming. Further, the ability of the secondary handle to iteratively extend into and out of the brush body with stability allows the small form factor of the hollow coupling rod of the secondary handle to be used a stabilizing guide against the animal's body which prevents injury and discomfort to the animal.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All features disclosed in the specification, claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

Throughout this disclosure, the phrase 'modularly coupled' and similar terms and phrases are intended to convey that any element of a given class of elements may be coupled to another given element and vice versa with equal effect. For example, any extension cord of a plurality of extension cords may be modularly coupled to another extension cord and vice versa with equal effect. Further, throughout this disclosure, the phrase 'removably coupled' and similar terms and phrases are intended to convey that a given element may be iteratively coupled to and removed from another given element as desired. For example, a male plug of a first extension cord may be removably coupled to a female plug of a second extension cord as desired.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "coupled" or "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A rotatable electric brush device, comprising:
a handle portion disposed at a proximal end of the rotatable electric brush device, wherein:
the handle portion comprises a hollow handle body having a handle exterior surface defining a handle cavity within the handle body,
the handle cavity comprises a portion of a driveshaft disposed therein, wherein the driveshaft is coupled to an electronic drive unit at a proximal end of the driveshaft,
the electronic drive unit is electronically coupled to a drive actuator that is not covered by the handle exterior surface,
a distal end of the driveshaft is not contained within the handle cavity and is not covered by the handle exterior surface, and
the distal end of the driveshaft comprises an inner sheath partially defining an engagement cavity; and
a brush portion disposed at a distal end of the rotatable electric brush device, wherein:
the brush portion comprises a hollow brush body having a brush exterior surface defining a brush cavity within the brush body,
the brush cavity comprises a shaft body and a portion of a secondary handle disposed therein,
the secondary handle comprises a hollow elongate coupling rod at a proximal end of the secondary handle and a gripping structure at a distal end of the secondary handle,
the hollow elongate coupling rod comprises a magnetic disc disposed therein,
the magnetic disc comprises a first degree of freedom of movement axially along the length of the hollow elongate coupling rod, and
the brush exterior surface comprises a plurality of elongate bristle members extending outward therefrom.

2. The rotatable electric brush device of claim 1, wherein a distal end of the hollow elongate coupling rod and the gripping structure are not contained within the brush cavity and are not covered by the brush exterior surface.

3. The rotatable electric brush device of claim 1, wherein the shaft body couples to the hollow elongate coupling rod via the magnetic disc at a proximal end of the secondary handle.

4. The rotatable electric brush device of claim 1, wherein the magnetic disc comprises a second degree of freedom of movement rotationally around a central axis of the hollow elongate coupling rod.

5. The rotatable electric brush device of claim 1, wherein the first degree of freedom of movement comprises a distal termination point at the distal end of the hollow elongate coupling rod and a proximal termination point at a proximal end of the hollow elongate coupling rod.

6. The rotatable electric brush device of claim 5, wherein:
the hollow elongate coupling rod comprises an outer shell defining a coupling rod cavity, and
the outer shell terminates into a crimped lip at the proximal end of the hollow elongate coupling rod.

7. The rotatable electric brush device of claim 1, wherein the gripping structure comprises a gripping structure cavity and an elongate vent.

8. The rotatable electric brush device of claim 7, wherein the elongate vent extends from a distal end of the gripping structure cavity to a distal end of the gripping structure.

9. The rotatable electric brush device of claim 7, wherein the elongate vent is in fluid air communication with a coupling rod cavity of the hollow elongate coupling rod.

10. The rotatable electric brush device of claim 1, wherein the brush cavity comprises a proximal cavity portion and a distal cavity portion.

11. The rotatable electric brush device of claim 10, wherein:
the proximal cavity portion comprises a proximal portion of the shaft body, and
the distal cavity portion comprises a distal portion of the shaft body and a proximal portion of the hollow elongate coupling rod.

12. The rotatable electric brush device of claim 10, wherein:
the proximal and distal cavity portions each comprise a cylindrical shape, and
the proximal cavity portion comprises a larger cavity diameter value than that of the distal cavity portion.

13. The rotatable electric brush device of claim 1, wherein a proximal end of the shaft body comprises a hexagonal shape and a first diameter value.

14. The rotatable electric brush device of claim 13, wherein a distal end of the shaft body comprises a second diameter value lesser than that of the first diameter value.

15. The rotatable electric brush device of claim 14, wherein:
a central portion of the shaft body is disposed between the proximal and distal ends of the shaft body, and
the central portion of the shaft body comprises a cylindrical shape.

16. A rotatable electric brush device, comprising:
a handle portion disposed at a proximal end of the rotatable electric brush device, wherein:
the handle portion comprises a hollow handle body having a handle exterior surface defining a handle cavity within the handle body,
the handle cavity comprises a portion of a driveshaft disposed therein, wherein the driveshaft is coupled to an electronic drive unit at a proximal end of the driveshaft,
the electronic drive unit is electronically coupled to a drive actuator that is not covered by the handle exterior surface,
a distal end of the driveshaft is not contained within the handle cavity and is not covered by the handle exterior surface, and
the distal end of the driveshaft comprises an inner sheath partially defining an engagement cavity; and
a brush portion disposed at a distal end of the rotatable electric brush device, wherein:
the brush portion comprises a hollow brush body having a brush exterior surface defining a brush cavity within the brush body,
the brush cavity comprises a proximal cavity portion and a distal cavity portion,
the proximal and distal cavity portions each comprise a cylindrical shape,
the proximal cavity portion comprises a larger cavity diameter value than that of the distal cavity portion,
the brush cavity comprises a shaft body and a portion of a secondary handle disposed therein, the secondary handle comprises a hollow elongate coupling rod at a proximal end of the secondary handle and a gripping structure at a distal end of the secondary handle, the hollow elongate coupling rod comprises a magnetic disc disposed therein, the magnetic disc comprises a first degree of freedom of movement axially along the length of the hollow elongate coupling rod, and the brush exterior surface comprises a plurality of elongate bristle members extending outward therefrom.

17. A rotatable electric brush device, comprising:

a handle portion disposed at a proximal end of the rotatable electric brush device, wherein:

the handle portion comprises a hollow handle body having a handle exterior surface defining a handle cavity within the handle body, the handle cavity comprises a portion of a driveshaft disposed therein, wherein the driveshaft is coupled to an electronic drive unit at a proximal end of the driveshaft, the electronic drive unit is electronically coupled to a drive actuator that is not covered by the handle exterior surface, a distal end of the driveshaft is not contained within the handle cavity and is not covered by the handle exterior surface, and the distal end of the driveshaft comprises an inner sheath partially defining an engagement cavity; and a brush portion disposed at a distal end of the rotatable electric brush device, wherein:

the brush portion comprises a hollow brush body having a brush exterior surface defining a brush cavity within the brush body, the brush cavity comprises a shaft body and a portion of a secondary handle disposed therein, a proximal end of the shaft body comprises a hexagonal shape and a first diameter value and a distal end of the shaft body comprises a second diameter value lesser than that of the first diameter value, the secondary handle comprises a hollow elongate coupling rod at a proximal end of the secondary handle and a gripping structure at a distal end of the secondary handle, the gripping structure comprises a gripping structure cavity and an elongate vent, and the brush exterior surface comprises a plurality of elongate bristle members extending outward therefrom.

* * * * *